United States Patent [19]

Monreal

[11] Patent Number: 4,744,584

[45] Date of Patent: May 17, 1988

[54] HANDLEBARS FOR TUCKED-IN SKIING

[76] Inventor: F. Javier Monreal, 718 State Tower Bldg., Syracuse, N.Y. 13202

[21] Appl. No.: 70,227

[22] Filed: Jul. 6, 1987

Related U.S. Application Data

[63] Continuation-in-part of Ser. No. 923,612, Oct. 27, 1986, abandoned.

[51] Int. Cl.[4] ..... A63C 5/06

[52] U.S. Cl. ..... 280/606; 280/809

[58] Field of Search ..... 280/606, 12 F, 15, 16, 280/21 R, 12 H, 809, 12 A, 601

[56] References Cited

U.S. PATENT DOCUMENTS

| | | | |
|---|---|---|---|
| 744,853 | 11/1903 | Anderson | 280/12 H |
| 2,564,420 | 8/1951 | Brown | 280/21 R |
| 3,139,287 | 6/1964 | Annis | 280/21 R |
| 3,269,742 | 8/1966 | Fuhyak et al. | 280/606 |
| 4,357,036 | 11/1982 | Zepkowski | 280/606 X |
| 4,363,495 | 12/1982 | Henson | 280/12 H |
| 4,643,444 | 2/1987 | Parkinson | 280/606 |

FOREIGN PATENT DOCUMENTS

| | | | |
|---|---|---|---|
| 200304 | of 1938 | Fed. Rep. of Germany | 280/12 F |
| 5476 | 1/1897 | Norway | 280/12 F |
| 65854 | 3/1943 | Norway | 280/12 F |

*Primary Examiner*—John J. Love
*Assistant Examiner*—Michael Mar

[57] ABSTRACT

This sporting, mechanical, paired, ski-steering device consists of a pair of upright curved, sturdy, handlebars attached straight up to the center of a snow ski (one per ski) in the area where standard ski bindings are mounted. The skier stands in the rear of the skis, one foot on each ski and with each foot maintained in position by a toe hold, and bends over or "tucks-in" grabbing with his/her hands these handlebars to provide control and steering. The handlebars can be directly attached to the center of the ski, but as a more convenient and versatile advantage, can also be locked on the ski by the ordinary ski bindings via a special sole that is sized and shaped at its two ends identical to the sole of the user's ski boots sole.

3 Claims, 2 Drawing Sheets

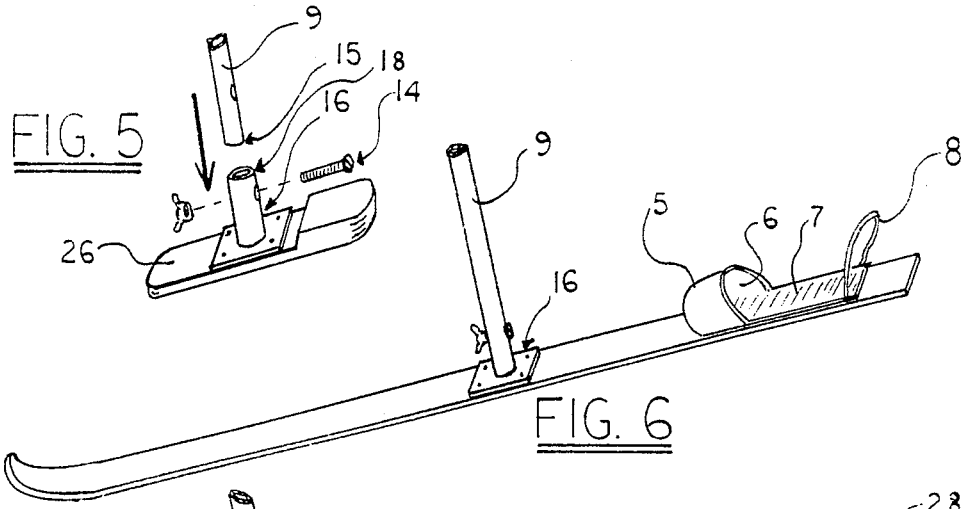
FIG. 5
FIG. 6
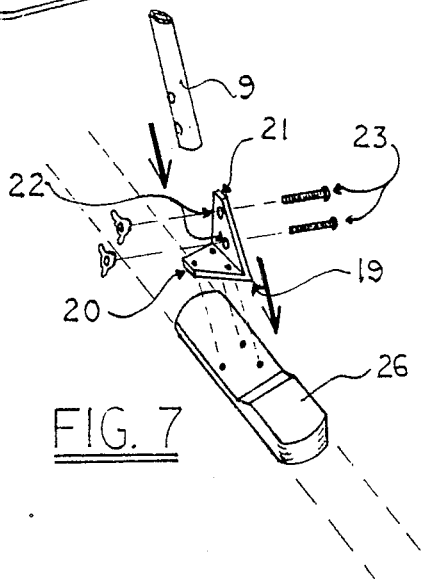
FIG. 7
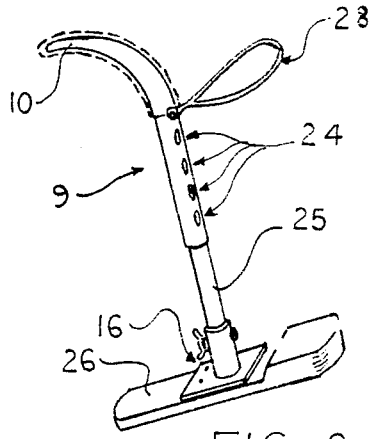
FIG. 8
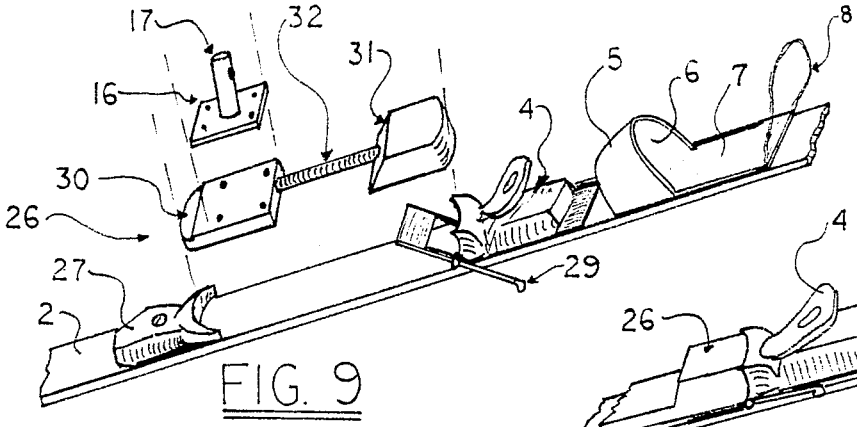
FIG. 9
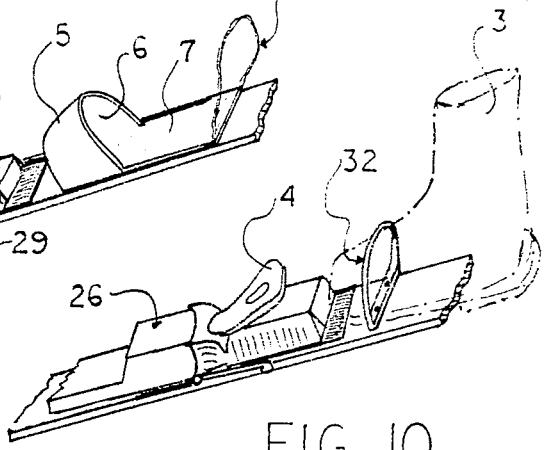
FIG. 10

HANDLEBARS FOR TUCKED-IN SKIING

This is a continuation-in-part of this inventor's earlier patent application Ser. No. 923,612 filed 10/27/86, now abandoned.

BACKGROUND AND PURPOSE

The purpose of this patent application is to provide the snow skier, primarily when speeding downhill, with a pair of handlebars for his/her hands while in a tucked-in or semi-squatted position. In this tucked-in position, the skier becomes more aerodynamic than upright, thus achieving faster speeds, but having less control of the ski with little torque for turns, he/she having to rely solely on knee rotation for turning (as opposed to the hip rotation that is possible in the erect position). This invention provides the skier with a direct hand-control of the turning via a pair of uprightand-curved handles (i.e. "skigrips") that are attached to the ski (one per ski) in the position where the ordinary ski-bindings go; that is just slightly behind the mid-point of the ski length.

In this inventor's earlier mentioned application for Handles for Tucked-in Skiing, now abandoned, the skier was locked in position by his/her feet at the ordinary place of the ski-bindings, thus the proposed handles had to be positioned way up front in the ski. The result, on extensive testing, was that such handles added little real maneuverability of the ski over what the foot alone had since the pivoting or turning/torque point of the ski especially a long, downhill ski is near its center. The so placed front handles permitted great speeds when pulled up (by better skimming the snow), but reducing the turning ability of the ski when bearing down. Such front placed handles had obvious limitations in practical terms for the average skier and average ski slope where for safety, control is emphasized over speed. Those handles would thus be limited to ad-hoc chutes and very straight downhill courses under very restricted circumstances.

In contrast to the abandoned application, this application places a similar type of upright handlebar, not in the front of the ski, but in the very place where one would normally place one's foot: between the ski-bindings and locked in position (thus removably) by them. With the handlebars locked between the regular ski-bindings the skier now places his/her feet immediately behind the standard heel-piece of the bindings, this invention providing a pocket-shaped hold for the skier's boot-tip. In this way the skier's weight is all in the rear half of the ski, thus the front of the ski can better skim over the snow, and at the same time with the skier/leaning forward and grabbing the proposed handles the turning/torque point of the ski is kept at best possible point, that is, near its center.

Extensive review of earlier prior art has been shown in the mentioned application. Additional prior art that specifically relates to handlebar attachments for skis include: The Ski Steering Apparatus of G.L. Parkinson (U.S. Pat. No. 4,643,444) which connects the front of the skis together with a handlebar attchment with telescoping and pivoting provisions, which in no way approaches this invention. The R.P. Brown's Ski Apparatus (U.S. Pat. No. 2,564,420) that consists of a rigid, tiltable frame with handlebars that are attached to the front tip of the skis, and is, in no way similar to this invention either. K.A. Henson's Sloping-Terrain Vehicle (U.S. Pat. No. 4,363,495) consists of a pair of handles attached together and holding the skis together by way of an articulated bridge; this device of his in no way accomplishes the purpose and versatility of this invention either.

BRIEF DESCRIPTION OF THE INVENTION

This paired sporting device is aimed at sliding on slippery slopes atop a pair of standard skis for snow or ice. Each skigrip or handlebar consists of a curved tubular inverted-L frame that goes attached upright to the ski near its center. This tubular frame is held in position via a special, rounded-and-rectangular specially shaped sole identical in thickness, shape and size, to the ski-boot sole of the user-skier. Such sole with its upright tubular frame or handle is locked in position by the ordinary ski-bindings. The skier places his/her feet on the ski behind the standard location, immediately behing the heel-pice of the regular binding and held firmly there by simply stepping into a pocket-shaped boot-toe hold. With the skier's boots held in this toe-hold and semis-quatted or bent over (i.e. "tucked-in") the skier grabs with his/her hands the upright tubular handles or "ski-grips" and skis downhill. A provision is made for these paired handlebars or skigrips to be directly attached to skis without a lockable ski-boot sole and thus without bindings. Various forms of attachment plates (i.e. male, female locking and side-to side parallel locking) are depicted. A provision is also made for some adjustability of the height of the handlebars and for a direct attachment to the ski without a ski-boot sole and bindings. Another provision is made for the special sole that locks into the ski bindings to have a length-adjusting mechanism so one sole can be locked into several lengths of permanently screwed-in bindings.

BRIEF DESCRIPTION OF THE FIGURES

FIG. 5 Depicts the bottom end of the handlebar or skigrip as a male-fitting lined up over the female attachment plate and sole.

FIG. 6 Depicts a direct attachment of the plate and its handlebar onto the ski without a special sole and without the need for bindings.

FIG. 7 Depicts a special angle-attachment-plate for parallel, side-to-side bolted connection of the handlebar to such plate.

FIG. 8 Depicts a single handlebar with a push-button telescopic heightadjusting mechanism.

FIG. 9 Depicts the ski bindings-lockable special attachment sole herewith provided with a length-adjusting bolt.

FIG. 10 Depicts a partial view of the rear of the ski with a simple elastic/adjustable strap as a toe hold fot the user's boot instead of the formed-pocket toe hold of FIG. 4.

DETAILED DESCRIPTION OF THE INVENTION

Figure 1:
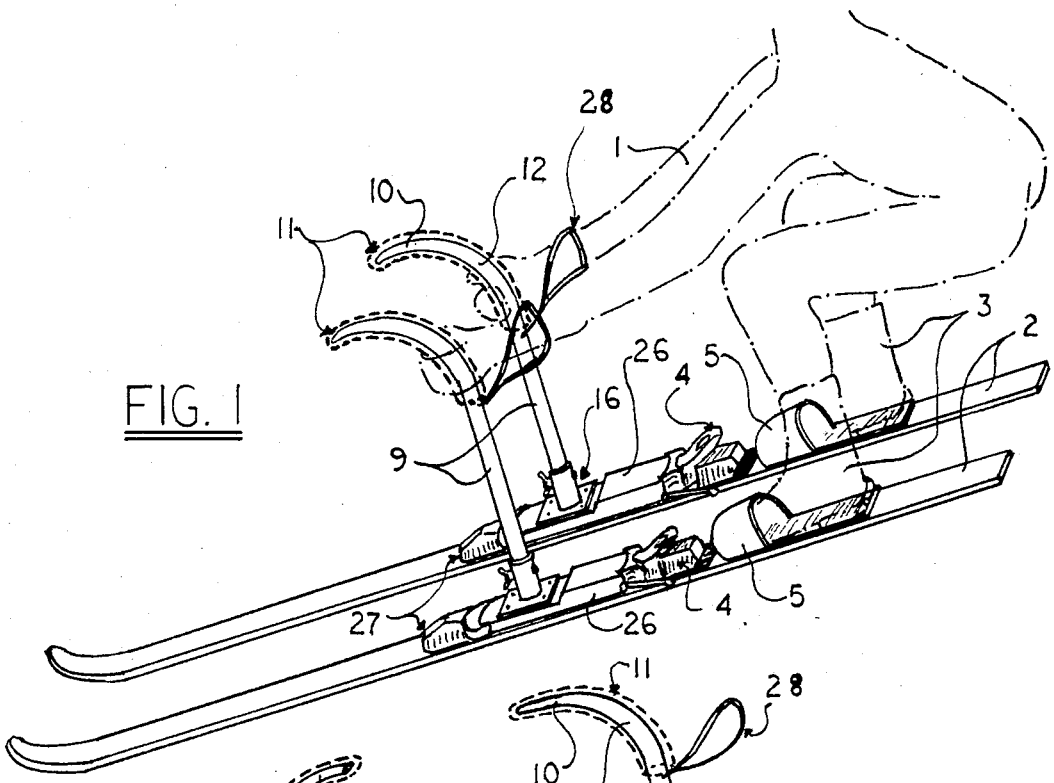
FIG. 1 Depicts a left lateral view of the instant invention, positioned in place on the skis and locked to them by the special sole. The rear toe hold is also shown and the tucked-in skier is drawn in dashed lines.

This paired recreational/sporting device is intended to aid the snow skier in balancing and in controlling the skis by providing means of direct hand control of the center portion of the ski as the skier leans forward or "tucks-in".

To accomplish this purpose, the skier 1 stands with his/her feet on the rear of the skis 2, wearing either his/her own regular boots or standard ski-boots 3. The skier's weight goes just behind the heel piece of the standard ski bindings 4. To keep the skier's boot firmly in place, this invention provides a simple step-in toe hold 5. This toe hold 5 is made of light weight plastic sheeting material molded into a concavity that provides a semi-snug fit for the tip of the skier's boot. This plastic toe hold 5 has the concavity 6 or toe hold proper, a rectangular and horizontal plate 7 and an elastic strap 8. The concavity 6 and the plate 7 are all one piece. The plate 7 is firmly screwed in position, behind the heel piece of the standard binding 4 with the concavity obviously facing rearward, and left thus permanently attached to the ski. The elastic/adjustable strap 8 holds the skier's heel so his/her foot will remain in position even in a bumpy downhill ride, but can easily dislodge and free the skier in a tumble.

The handlebars 9 of the paired device, being identical to one another, consist each of a rounded, light weight tubular frame, ½" to 1" in cross sectional diameter, in the approximate shape of an inverted letter L with a rounded angle. The horizontal upper portion 10 of the handle bar is horizontally flattened at its free tip. This horizontal portion 10 is provided with a rubberized non-slip padding 11 that covers as a continuous sheath the horizontal portion and the rounded angle 12 of the handlebar 9.

The vertical portion of the handlebar(s) 9 has a horizontal perforation 13 approximately 2½" from its bottom free end. This through-perforation accomodates a perforating and securing bolt/wing nut arrangement 14. The bottom free end 15 of the handlebar fits snuggly as a female component over the short, 3" tall vertical stem, with a matching perforation of the attachement plate 16. This plate 16 is a rectangular, 2" to 2½" wide by 3" to 4" long by ⅛" to ¼" thick sheet of metal with a short, 3" tall vertical stem in its center identified by the numeral 17.

A provision is made in FIG. 5 to show the same described connection of bottom of handlebar 9 to attachment plate 16, but wherein the short vertical stem of the plate is here wider than the handlebar so in this fitting, the handlebar becomes the male part inside the short stem 18 of the attachment plate 16, being the perforation and bolt similar for both types of fitting.

A provision is also made in FIG. 7 for the fitting between the bottom of the handlebar and the attachment plate to be a bolted, parallel and side-by-side fitting. The attachment plate here is identified by the numeral 19, plate that is a square-angled piece wherein its horizontal portion has an approximately rectangular/trapezoidal shape with 3 to 4 perforation to accomodate fastening screws, portion marked as 20. The vertical portion 21 of this plate 19 has two vertically lined up perforations 22 aimed at accomodating 1" to 1½" bolts 23. These two bolts 23 hold together the plate 19 and, vertically, the handlebar 9. In a situation where the skier (or ski jumper) may desire to have the handlebars tilt forward or backward, only the top bolt of the two marked as number 23 would be used as a fastened, and at the same time, as a pivoting point for the handlebar.

While the preliminary optimal height of the described handlebars would seem the mid-thigh level of the skier, personal preference, the skier's flexibility, the shoewear used and the level of speed and competition, may dictate lower or higher hand-grip position. Thus this invention, as per FIG. 8, makes a provision for the handlebars to have a height adjustment mechanism: The vertical portion of the handlebar 9 has two tubular segments telescoped into one anpther, one of them having a series 24 of vertically lined up holes, destined to lock the inner segment in position at a particular desired height, via a spring-loaded push-button located in the inner and thinner segment 25.

While the attachment plates 16 (with male or female stem) or 19 can be directly fastened to the mid-section of the ski 2 as in FIG. 6, this invention looks particularly at making the described handlebars 9 and their use, totally compatible with an ordinary, standard set of skis with an attached set of standard ski bindings. For this purpose, FIGS. 1, 2, 3, 5 and 7 depict the said handlebars 9 attached to their attachment plate (numerals 16 and 19), and the attachment plate in turn being fastened over a rectangular, rounded board 26 shaped and sized identical to the size of the skier's standard ski-boot sole. This means that this board or sole 26 has front and rear rounded edges, being thicker in the rear and perfectly fitting into the strong lock provided by the standard ski bindings with their heel piece 4 and their toe piece 27. The material of the sole 26 can be either wood or plastic as in current use in the ski boot industry. This important sole 26 makes this handlebar very versatile as it allows marketing of the device to those already in posession of standard skis, plus it allows skiers to use their skis either in a standard fashion or in the herewith proposed tucked-in-with-handlebars position. It also allows skiers to "stand" normally on their skis locked into the bindings to take the chair-lift (carrying this device on their back pack) and to decide at the top of the slope which way to ski downhill.

Figure 2:
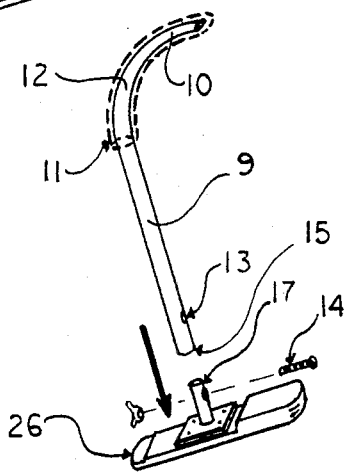
FIG. 2 Depicts one handle bar or skigrip separated from its sole and position so it is mounted with its upper curved portion facing rearward.
Figure 3:
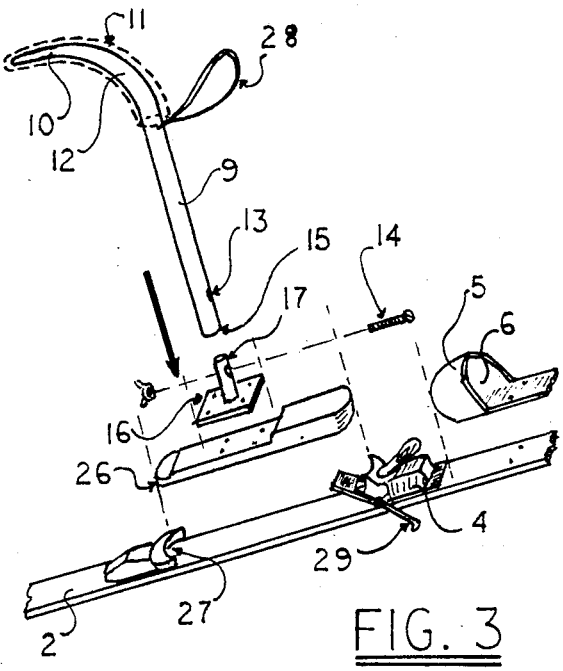
FIG. 3 Depicts a single handlebar or skigrip with its upper curved portion facing forward and each attachable/lockable element separated, but lined up in position from the ski and bindings to the skigrip and toe hold. The bottom of the handlebar acts as a female part over the plate.
Figure 4:
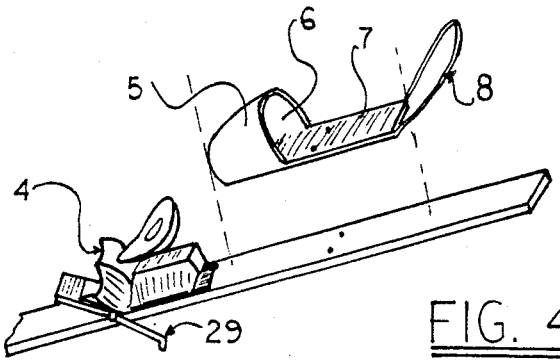
FIG. 4 Depicts the toe hold lined up over the ski behind the standard heel pice of the bindings.

A provision is made by this invention to allow the skier the placement of the described handlebars 9 with their padded top horizontal portion 10 facing frontward or the direction of travel, or rearward as in FIG. 2, this depending on the skier's height, preference, etc. The tip of the horizontal portion 10 is horizontally flattened to allow the skier the simultaneous hand-grip of ski pole (if he/she carries them) and of these handlebars in such a way that the handle of the ski pole rests directly above the flattened portion 10 of the handlebar(s) 9.

A string-like leather or plastic loop 28 is fastened to the handlebar so the skier can pass his/her hand through it and thus retain a hold of the handlebar(s) in a tumble. This item is also important: In a tumble at low speeds, the skier is likely to fall to the side while continuing to hold on to the described handlebars 9 and thus nothing runs off to get lost down hill or to hit others; in a tumble at greater speeds the skier may let go of the handlebars, so skis and handlebars together could run off unattended, but now with the safety loop 28, the handlebars stay with the skier; if in this case the ski bindings do not release the described sole 26, then the whole apparatus stays with the skier, but if the bindings do release, the skier keeps only the handlebars-and-sole device and the unattended skis with their built-in automatic brakes 29 come by themselves to a quick stop. This brake device is commonly required by current regulations in ski resorts.

A provision is made, as shown in FIG. 9, to have the ski boot sole-shaped special sole 26 adjustable to different lengths, so the device can be used by different skiers of different boot size. This may be important as a ski-rental item where the separate pieces of the ski gear are used (rented) by many subjects. For this purpose, the described sole 26, with its specially thinner front and thicker back is cut off into two separate pieces, front 30 and rear 31, the front piece 30 having attached with screws the attachment plate 16 provided in turn either with a vertical male stem 17, or a female stem 18. Both front and rear pieces of this sole, 30 and 31 respectively, are interconnected by a built-in bolt 31. This bolt 31 is glued firmly into a single block to front piece 30 and then put in position by entering the matching threaded opening lined up in rear piece 31. No torsion-locking device is necessary as torsion and dislodging will be prevented by the sole 26 being locked into the ski bindings when in use.

While the main practical and marketable point of this invention may be its locking-in-position-on-the-ski sole shaped identical to the sole of standard ski boots, which makes the device (and thus the bindings) versatile and accesible to those who already have skis, its major argument and key point for mechanical advantage over the author's prior applications Ser. Nos. 890,029 and 923,612 (both abandoned) and over the earlier prior art of others, is the placement of the handles over the center of mid-point of the ski. In those inventions, the steering handles, shaped or mechanically connected one way or another to one or to both skis, are mounted on the front part of the ski(s). Extensive testing indicates that the more forward on the skis the handles or steering devices are, the less steerable the skis are. Indeed, pulling up on the handles and trying to turn the whole thing makes the front of the skis skim the snow, thus speeding down too fast beyond easy control to turn them; pushing on them or bearing weight on them makes the skis "track" or run down in parallel, again making turning very difficult. In contrast, in this invention, the handlebars are placed in the center of the ski in the spot where on standard skis with standard bindings the skier's weight is located, thus leaving free the front of the skis to quickly respond to the torque applied to their center portion.

A provision is also made for the toe hold 5 to consist simply of an elastic/adjustable transverse strap 32 as shown in FIG. 10.

What I now claim is:

1. A sporting, paired, ski-steering device for use with a pair of skis having standard toe and heel ski bindings mounted thereon, said device being capable of providing a snow skier with hand steering controls of the skis and includes foot holders for securing the skier's boots to the skis, each member of the pair being identical to one another and each one comprising:

an upright handlebar made of a lightweight rounded metal tubing having a straight vertical portion with a height approximately that of the user's knee, a free bottom end, and a curved portion extending from the top of said straight vertical portion and curving smoothly with an approximate six inch radius into a horizontal portion of approximately four inches in length, said horizontal portion having a free top end and being horizontally flattened along its length; a perforation extending through said straight vertical portion at a location adjacent said free bottom end, said straight vertical portion having at its upper end adjacent said curved portion a string-like strap secured thereto forming a loop capable of extending around the user's wrist; a continuous non-slip rubberized sleeve enclosing said curved and horizontal portions of said handlebar;

an attachment metal bracket consisting of a welded or cast metal block having a rectangular horizontal plate and an upright stem extending vertically from the center of said horizontal plate, said horizontal plate having a hole at each of its four corners for accommodating a fastener, said upright stem having a perforation extending therethrough and said upright stem being recivable within the free bottom end of said vertical portion of said handlebar; a fastening bolt provided with a hand-fastenable wing nut, said bolt extending through said perforations within said upright stem and said vertical portion of said handlebar;

a sole plate comprising a rectangular structure having rounded corners with a thin front end and a thicker rear end, said front and rear ends being of the same shape and thickness as a that of a standard ski boot sole; said horizontal plate of said attachment metal bracket being secured to the upper surface of said sole plate by screw fasteners; said pole plate being adapted to be releasably secured between said tow and heel bindings of said ski; said upright handlebars being adapted to be mounted on said vertical upright stem with said flattened horizontal portion extending in either a forward direction or a rearward direction; and a foot holder made of lightweight molded plastic having a rectangular, flat portion capable of receiving the weight of the skier standing thereon, said flat portion being firmly screwed to the upper surface of said ski immediately behind said standard rear heel binding, an upwardly extending front portion having a rearwardly facing open cavity for receiving the front portion of the skier's boot, and an elastic loop secured to the rear end of said flat portion for engaging the rear portion of the skier's boot while secured by said foot holder.

2. A ski-steering device according to claim 1 wherein said straight vertical portion of said upright handlebar comprises two telescoping tubular members having a plurality of aligned apertures extending therethrough and releasable fastener means extending through said aligned apertures for adjusting the length of said straight vertical portion.

3. A ski-steering device according to claim 1 wherein said sole plate includes a front portion, a rear portion, and means for varying the spacing between said front and rear portions, wherein said horizontal plate is secured to the upper surface of said front portion.

* * * * *